US006466912B1

(12) United States Patent
Johnston

(10) Patent No.: US 6,466,912 B1
(45) **Date of Patent: *Oct. 15, 2002**

(54) PERCEPTUAL CODING OF AUDIO SIGNALS EMPLOYING ENVELOPE UNCERTAINTY

(75) Inventor: James David Johnston, Warren, NJ (US)

(73) Assignee: AT&T Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/937,950

(22) Filed: Sep. 25, 1997

(51) Int. Cl.[7] ..... G10L 19/00
(52) U.S. Cl. ..... 704/500; 704/226
(58) Field of Search ..... 704/226–229, 704/500–504, 203

(56) References Cited

U.S. PATENT DOCUMENTS 4,896,362 A * 1/1990 Veldhuis et al. ..... 381/30
5,105,463 A * 4/1992 Veldhuis et al. ..... 381/30
5,136,377 A * 8/1992 Johnston et al. ..... 358/136
5,161,210 A * 11/1992 Druyvesteyn et al. ..... 395/2
5,471,558 A * 11/1995 Tsutsui ..... 395/2.28
5,550,924 A * 8/1996 Helf et al. ..... 381/94
5,553,193 A * 9/1996 Akagiri ..... 395/2.38
5,583,967 A * 12/1996 Akagiri ..... 395/2.38
5,682,463 A 10/1997 Allen et al.
5,684,920 A * 11/1997 Iwakami et al. ..... 704/203
5,699,479 A 12/1997 Allen et al.
5,864,820 A * 1/1999 Case ..... 704/278
5,890,125 A * 3/1999 Davis et al. ..... 704/501
5,911,128 A * 6/1999 DeJaco ..... 704/221

OTHER PUBLICATIONS

"Information technology—Coding of moving pictures and associated audio for digital storage media at up to about 1,5 Mbit/s–", Part 3: Audio, ISO/IEC 11172–3, 1993.*

* cited by examiner

*Primary Examiner*—Fan Tsang
*Assistant Examiner*—Michael N. Opsasnick

(57) ABSTRACT

Perceptual coding is accomplished by measuring the envelope roughness of the filtered audio signal, which may be directly converted to the noise to mask threshold needed to calculate the perceptual threshold or "just noticeable difference". Thus, the present invention does not require any complex calculations to determine tonality, either by a measure of predictability or by the calculation of a loudness or loudness uncertainty. Instead, the envelope roughness of the signal is simply reduced directly to the noise to mask ratio.

10 Claims, 2 Drawing Sheets

PERCEPTUAL CODING OF AUDIO SIGNALS EMPLOYING ENVELOPE UNCERTAINTY

FIELD OF THE INVENTION

This invention relates to perceptually-based coding of audio signals, such as monophonic, stereophonic, or multichannel audio signals, speech, music, or other material intended to be perceived by the human ear.

BACKGROUND OF THE INVENTION

Demands in the commercial market for increased quality in the reproduction of audio signals have led to investigations of digital techniques which promise the possibility of preserving much of the original signal quality. However, a straight-forward application of conventional digital coding would lead to excessive data rates; so acceptable techniques of data compression are needed.

One signal compression technique, referred to as perceptual coding, employs the idea of distortion or noise masking in which the distortion or noise is masked by the input signal. The masking occurs because of the inability of the human perceptual mechanism to distinguish two signal components (one belonging to the signal and one belonging to the noise) in the same spectral, temporal, or spatial locality under some conditions. An important effect of this limitation is that the perceptibility (or loudness) of noise (e.g., quantizing noise) can be zero even if the objectively measured local signal-to-noise ratio is low. Additional details concerning perceptual coding techniques may be found in N. Jayant et al., "Signal Compression Based on Models of Human Perception," Proceedings of the IEEE, Vol. 81, No. 10, October 1993.

U.S. Pat. No. 5,341,457 discloses a perceptual coding technique in which a perceptual audio encoder is used to convert the audio signal (or a function thereof) into a measure of predictability (e.g., a spectral flatness measure) and then into a tonality metric from which a noise to mask ratio can be calculated, using knowledge provided by controlled subjective testing of the masking properties of tones and noise. Other techniques calculate the tonality metric from a loudness or loudness uncertainty calculation. These known perceptual coding techniques are either computationally inefficient, provide incorrect noise to mask ratios for some kinds of audio signal, or both.

Accordingly, it is desirable to provide a perceptual coding technique that reduces the complexity of the required computations while increasing the accuracy of the resulting noise to mask ratios.

SUMMARY OF THE INVENTION

The inventor has determined that accurate perceptual coding does not require a measure of tonality. Rather, perceptual coding is accomplished by measuring the envelope roughness of the filtered audio signal, which may be directly converted to the noise to mask threshold needed to calculate the perceptual threshold or "just noticeable difference". Thus, the present invention does not require any complex calculations to determine tonality, either by a measure of predictability or by the calculation of a loudness or loudness uncertainty. Instead, the envelope roughness of the signal is simply reduced directly to the noise to mask ratio.

DETAILED DESCRIPTION

Figure 1:
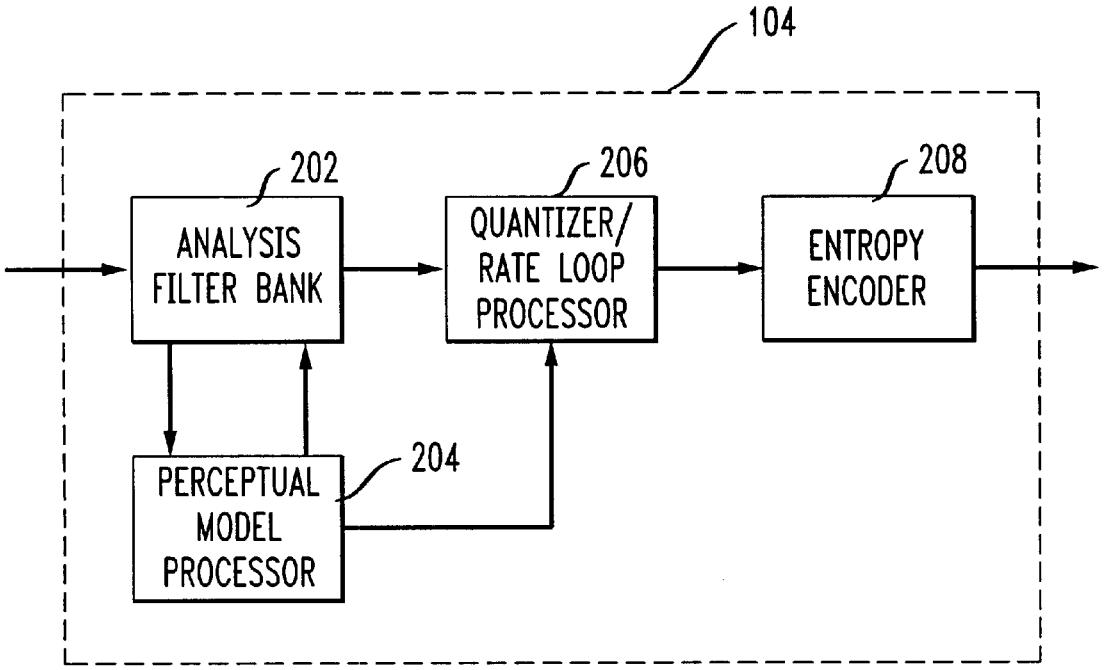
FIG. 1 shows a block-diagram of an illustrative perceptual audio coder in accordance with the present invention.

An illustrative embodiment of a perceptual audio coder 104 is shown in block diagram form in FIG. 1. The perceptual audio coder of FIG. 1 may be advantageously viewed as comprising an analysis filter bank 202, a perceptual model processor 204, a quantizer/rate-loop processor 206 and an entropy coder 208.

The filter bank 202 in FIG. 1 advantageously transforms an input audio signal in time/frequency in such manner as to provide both some measure of signal processing gain (i.e. redundancy extraction) and a mapping of the filter bank inputs in a way that is meaningful in light of the human perceptual system. Advantageously, in one embodiment of the invention, the well-known Modified Discrete Cosine Transform (MDCT) described, e.g., in J. P. Princen and A. B. Bradley, "Analysis/Synthesis Filter Bank Design Based on Time Domain Aliasing Cancellation," IEEE Trans. ASSP, Vol. 34, No. 5, October, 1986, may be adapted to perform such transforming of the input signals.

The perceptual model processor 204 shown in FIG. 1 calculates an estimate of the perceptual threshold, noise masking properties, or just noticeable noise floor of the various signal components in the analysis bank. In one embodiment of the invention, the processor 204 calculates a noise to mask ratio, from which the masking threshold may be directly calculated. Signals representative of these quantities are then provided to other system elements to provide control of the filtering operations, quantization operation and organizing of the data to be sent to a channel or storage medium.

The quantizer and rate control processor 206 used in the illustrative coder of FIG. 1 takes the outputs from the analysis bank and the perceptual model, and allocates bits, noise, and controls other system parameters so as to meet the required bit rate for the given application. In some example coders this may consist of nothing more than quantization so that the just noticeable difference of the perceptual model is never exceeded, with no (explicit) attention to bit rate; in some coders this may be a complex set of iteration loops that adjusts distortion and bitrate in order to achieve a balance between bit rate and coding noise.

Entropy coder 208 is often used to achieve a further noiseless compression in cooperation with the rate control processor 206. In particular, entropy coder 208 receives inputs including a quantized audio signal output from quantizer/rate loop 206, performs a lossless encoding on the quantized audio signal, and outputs a compressed audio signal to a downstream communications channel/storage medium.

The perceptual model processor calculates a noise to mask ratio or a masking threshold in the following manner. As is well known in psychoacoustics, the "Bark Scale" comprises approximately 25.5 critical bands, or "Barks", representing a scale that maps standard frequency (Hz) into approximately 25.5 bands over the frequencies perceived by the human auditory system. In any 1-bark section of the scale, i.e. from 1 to 2 barks, or from 7.8 to 8.8 barks, the masking behavior of the human ear remains approximately constant. This Bark scale approximates the varying bandwidths of the cochlear filters in the human cochlea.

To calculate the NMR the perceptual model processor 204 first performs a critical band analysis of the signal and applies a spreading function to the critical band spectrum.

The spreading function takes into account the actual time and/or frequency response of the cochlear filters that determine the critical bands.

More particularly, processor 204 receives the complex spectrum and converts it to the power spectrum. The spectrum is then partitioned into ⅓ critical bands, and the energy in each partition summed.

Additional details concerning the spreading function may be found in the article by M. R. Schroeder et al., "Optimizing Digital Speech Coders by Exploiting Masking Properties of the Human Ear," J. Acoustical Society of America, Vol. 66, December 1979, pp. 1647–1657.

In one particular embodiment of the invention, the entire audio spectrum, sampled at 44.1 kHz, and analyzed by a 1024 band transform, (the "real" part of this transform corresponds exactly to the MDCT cited before) is divided into approximately ⅓ bark sections, (yielding a total of 69 frequency bands, less than the expected 75 due to frequency quantization and roundoff errors in the mapping of the filterbank bins to the ⅓ bark bins). In other implementations, the number of frequency bands will vary according to the highest critical band and filterbank resolution at a given sampling rate as the sampling rate is changed. In each of these bands, or calculation partitions, the energy of the signal is summed. This process is also carried out on two similarly partitioned 512 band transforms, four 256 band transforms, and eight 128 band transforms, where the two, four and eight transforms are calculated on the data centered in the 1024 band transform window, with the multiple transforms calculated on adjacent, time-contiguous segments so that one set of partition energies from the 1024 band spectrum, two time-adjacent sets of 512, 4 256, and 8 128 band spectra are calculated. In addition, the values for the immediately preceding time segments for each size of transform are also retained. For each of these individual sets of summed energies, the previously mentioned spreading function is used to spread the energy over the bands to emulate the frequency response of the cochlear filters. This is implemented as a convolution, where the known-zero terms are omitted. The outputs of this process are called the "spread partition energy" and roughly represent the energy of the cochlear excitation in the given band for the given time period. In practice, for the purpose of calculating the envelope roughness, the spread partition energies corresponding to the long (1024) spectrum need only be calculated up to 752 Hz (table 1), the two 512 spectra from that frequency to 1759 Hz (table 1), the four 256 line spectra from that frequency to 3107 Hz, and the eight 128 line spectra from that point up to the highest frequency being coded. The data specified corresponds to an approximation of the time duration of the main lobe of the cochlear filter, in order to match the calculation process to that of the human ear.

In the prior art previously mentioned, either the power spectrum, before partitioning and spreading, or some measure of predictability or loudness/loudness uncertainty was used to calculate a tonality index or indices. In contrast, the present invention calculates a signal envelope uncertainty or roughness, which can be directly converted into the desired NMR. This technique takes into account recent psychoacoustic work that suggests that the "tonal" or "noise-like" nature of a signal is not the issue of interest. Rather, the masking ability of a signal depends on its envelope roughness inside a given cochlear filter band. For a single tone or narrow band noise, these two ideas are roughly equivalent. However, for more complex signals, such as AM vs. narrowband FM modulated signals, the envelope roughness measure provides substantially different results than the tonality or predictability methods. The NMR calculated by the envelope roughness measure matches the actual masking results observed in the auditory system much better than those calculated by the tonality method. While the loudness uncertainty method provides results more in accord with the envelope roughness measure, the use of loudness uncertainty requires complex cochlear filter, signal combination, and non-linear loudness calculations in order to approach the same performance.

The envelope roughness env(t) is calculated by determining for each spread partition energy the value of:

$$env(t) = \frac{|E(t) - E(t-1)|}{\text{maximum}(E(t), E(t-1)}$$

where E(t) is the envelope energy for the given frequency band centered at time t. In another embodiment of the invention, a temporal noise shaping filter measures the temporal prediction gain (as opposed to the prediction gain in frequency used in the prior art) or envelope flatness of the signal, from which the envelope roughness can be determined.

The desired NMR(t) is simply proportional to the square of env(t). However, in an exemplary embodiment of the invention, a recursive filtering technique may first be applied to the envelope roughness to smooth it out over the integration time of the human auditory system. The recursive filtering technique implements a simple first-order recursive filter, i.e. senv(t)=alpha*senv(t—1)+(1-alpha)*env(t). In this case, the NMR is proportional to the value square of senv, rather than env. In either case, the final value of the NMR is limited to the observed maximum and minimum values for NMR observed by the human auditory system at that Bark frequency.

The perceptual model processor 204 directs the value of the NMR (or the masking threshold) to the quantizer 206, which uses this value to quantize and process the output from the filter band 202 in accordance with techniques known to one of ordinary skill in the art.

In a stereo or multichannel coder, the NMR or envelop uncertainties calculated for any jointly coded channels in any given calculation bin may be combined, for instance by selecting the smallest (e.g., best SNR) NMR to calculate an NMR or perceptual threshold for a jointly coded signal.

Figure 2:
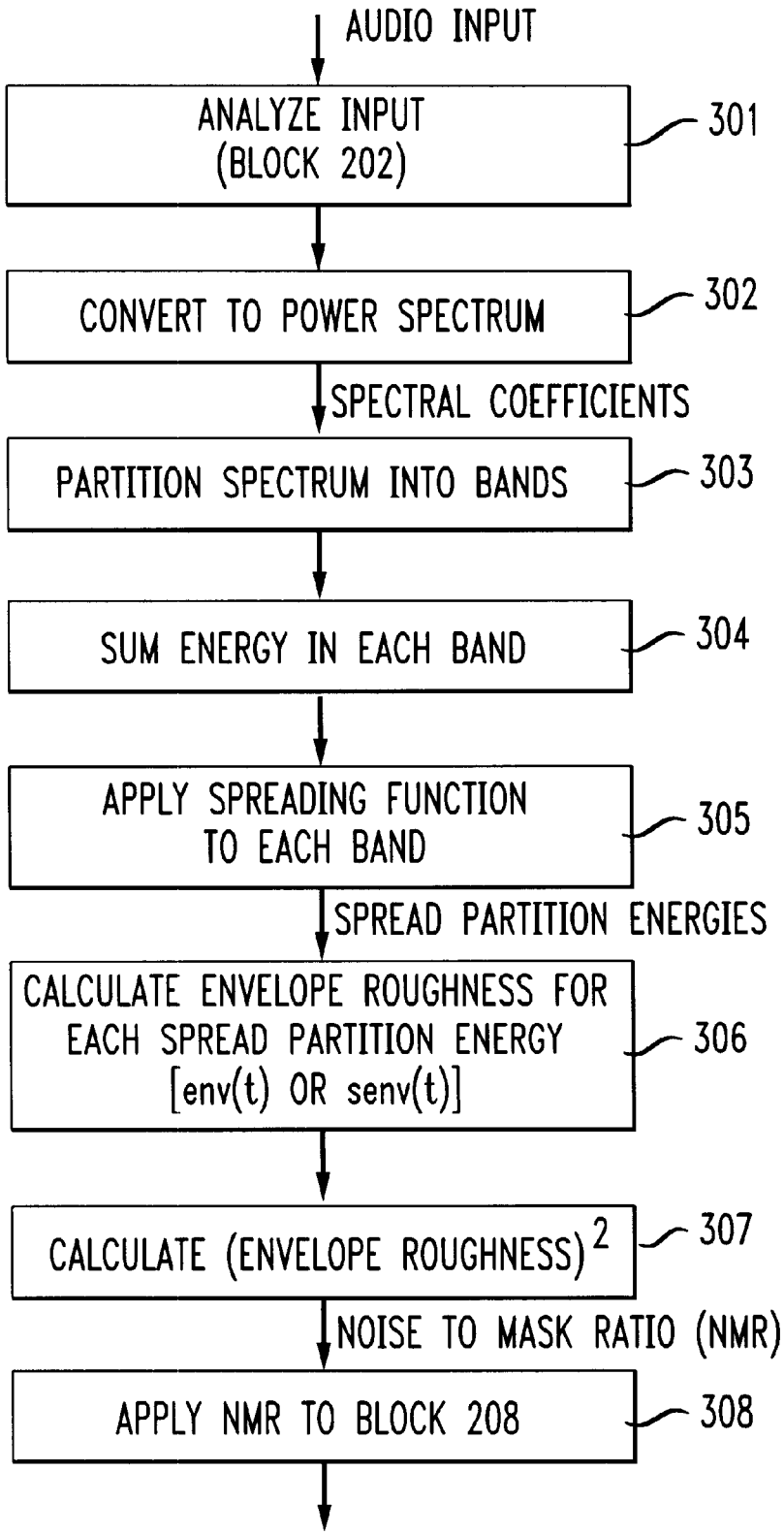
FIG. 2 presents a flowchart of an encoding process in accord with the principles disclosed herein.

FIG. 2 presents a flowchart of a process that is carried out in an illustrative embodiment of FIG. 1. The process begins at block 301, where an applied audio signal is analyzed, as described above. Illustratively, the analysis develops a set of complex spectrum coefficients. This set is converted to power spectrum coefficients in block 302, which then passes control to block 303. Block 303 partitions the developed set of power spectrum coefficients into bands, and as indicated above, such a division may be structured so that each band encompasses a ⅓ bark band. Once the bands are established, control passes to block 304, where the power spectrum coefficients in each band are summed. Each summed band energy is then processed in block 305 with a spreading function, as described above, to develop spread partition energies. For each spread spectrum energy an envelope roughness measure is calculated in block 306. As described above, two types of calculations were found to be useful: env(t) and senv(t). Control then passes to block 307, where the envelope roughness calculations of block 306 are squared, to develop measures that are proportional to the noise-to-mask ratio. In accordance with the principled disclosed herein, these developed noise-to-mask ratio signals are applied, as indicated by block 308, to block 208 of FIG. 1. It may be noted that the FIG. 2 process can be carried out a multiple number of times, for example in parallel, to allow the aforementioned joint coding of to parallel audio channels (for example, coding a set of 1024 spectrum coefficients, and corresponding two sets of 512 spectrum coefficients).

What is claimed is:

1. A method of processing an ordered time sequence of at least one audio signal partitioned into a set of ordered blocks, each of said blocks having a discrete frequency spectrum comprising a first set of frequency coefficients, the method comprising, for each of said blocks, the steps of:

(a) grouping said first set of frequency coefficients into groups having a relationship to critical bands or to cochlear filter bandwidths, each group comprising at least one frequency coefficient;

(b) generating an envelope roughness measure for each group;

(c) generating a noise to mask ratio based on said envelope roughness;

(d) quantizing at least one frequency coefficient in said at least one group, said quantizing being based upon said noise to mask ratio.

2. The method of claim 1 wherein said step of generating an envelope roughness of a group includes the step of summing energy of frequency coefficients in said group.

3. The method of claim 1 wherein said step of generating an envelope roughness of a group includes the step of summing energy of frequency coefficients in said group followed by a step of processing said group by employing the frequency response of a cochlear filter.

4. The method of claim 1 wherein said step of generating an envelope roughness measure develops said envelope measure from application of a spreading function to summed energy of said frequency coefficients.

5. The method of claim 4 wherein said spreading function is taken from a set that includes functions env(t) and senv(t), where $$env(t) = \frac{|E(t) - E(t-1)|}{\max(E(t), E(t-1))}$$

and $$senv(t)=\alpha \cdot senv(t-1)+(1-\alpha)\cdot env(t),$$

where E(t) represents envelope energy for a given frequency band centered at time t, and $\alpha$ is a constant.

6. The method of claim 1 wherein said audio signal includes at least two jointly coded audio channels and further comprising the steps of performing steps (a)–(d) for said at least two audio channels and further comprising the step of combining said envelope roughness of said at least two channels to determine an NMR for said signal.

7. The method of claim 2 wherein said audio signal includes at least two jointly coded audio channels and further comprising the steps of performing steps (a)–(d) for said at least two audio channels and further comprising the step of combining said envelope roughness of said at least two channels to determine an NMR for said signal.

8. The method of claim 3 wherein said audio signal includes at least two jointly coded audio channels and further comprising the steps of performing steps (a)–(d) for said at least two audio channels and further comprising the step of combining said envelope roughness of said at least two channels to determine an NMR for said signal.

9. The method of claim 4 wherein said audio signal includes at least two jointly coded audio channels and further comprising the steps of performing steps (a)–(d) for said at least two audio channels and further comprising the step of combining said envelope roughness of said at least two channels to determine an NMR for said signal.

10. The method of claim 5 wherein said audio signal includes at least two jointly coded audio channels and further comprising the steps of performing steps (a)–(d) for said at least two audio channels and further comprising the step of combining said envelope roughness of said at least two channels to determine an NMR for said signal.

* * * * *